US008106332B2

(12) United States Patent
Menu et al.

(10) Patent No.: US 8,106,332 B2
(45) Date of Patent: Jan. 31, 2012

(54) ELECTRICAL CONNECTOR FOR AUTOMOTIVE GLAZING

(75) Inventors: Thierry Menu, Guyancourt (FR); Camillo Piguzzi, Turin (IT)

(73) Assignees: Pilkington Automotive France SA, Limay (FR); Pilkington Italia S.p.A., San Salvo (Chieti) (IT)

( * ) Notice: Subject to any disclaimer, the term of this patent is extended or adjusted under 35 U.S.C. 154(b) by 117 days.

(21) Appl. No.: 12/519,934

(22) PCT Filed: Dec. 21, 2007

(86) PCT No.: PCT/EP2007/064521

§ 371 (c)(1),
(2), (4) Date: Jun. 18, 2009

(87) PCT Pub. No.: WO2008/074894

PCT Pub. Date: Jun. 26, 2008

(65) Prior Publication Data

US 2010/0112868 A1 May 6, 2010

(30) Foreign Application Priority Data

Dec. 21, 2006 (EP) ..... 06425857

(51) Int. Cl.
*H05B 1/02* (2006.01)

(52) U.S. Cl. ..... 219/203

(58) Field of Classification Search ..... 439/521; 219/203, 522, 543, 219
See application file for complete search history.

(56) References Cited

U.S. PATENT DOCUMENTS

| | | | | | |
|---|---|---|---|---|---|
| 2,429,420 | A * | 10/1947 | McMaster | ..... | 219/547 |
| 3,532,858 | A * | 10/1970 | Peetz | ..... | 219/522 |
| 5,434,384 | A * | 7/1995 | Koontz | ..... | 219/203 |
| 5,821,501 | A * | 10/1998 | Zorn | ..... | 219/219 |
| 7,180,031 | B1 * | 2/2007 | Loibl et al. | ..... | 219/203 |
| 7,270,548 | B2 * | 9/2007 | Jenrich et al. | ..... | 439/34 |

FOREIGN PATENT DOCUMENTS

| | | | | |
|---|---|---|---|---|
| EP | 0 607 067 | A1 | 7/1994 | |
| EP | 630170 | * | 12/1994 | ..... 219/203 |
| EP | 1 139 697 | A2 | 10/2001 | |
| EP | 1 256 261 | B1 | 11/2002 | |
| FR | 2 706 724 | A1 | 12/1994 | |

OTHER PUBLICATIONS

International Search Report (PCT/ISA/210) dated Apr. 8, 2008.
European Search Report dated May 29, 2007 issued in the corresponding European Patent Application No. 06425857.7-1231.
English-language translation of EP 0 630 170 A1.

* cited by examiner

*Primary Examiner* — Neil Abrams
(74) *Attorney, Agent, or Firm* — Buchanan Ingersoll & Rooney PC

(57) ABSTRACT

A connector is shaped to receive the edge region of an automotive glazing between opposing connector arms. A first surface of the automotive glazing is provided with a first electrical function situated thereon, and a second surface of the automotive glazing is provided with a second electrical function situated thereon. Connector arms carry wiring for the automotive glazing electrical functions. The connector further includes a cap which covers one connector arm and a connection between the wiring carried by that arm to the electrical function on the surface of the glazing.

20 Claims, 3 Drawing Sheets

ELECTRICAL CONNECTOR FOR AUTOMOTIVE GLAZING

The present invention relates to a connector for use with an automotive glazing, in particular, an openable automotive glazing.

Automotive glazings are often provided with functions that require electrical power. For example, heating circuits and antenna circuits may be provided on a backlight (the rear window of a vehicle). To enable the supply of power to the circuit, a connection must be made between the circuit and the wiring harness of the vehicle. Where a glazing is formed from a single ply of glass, the connection may be formed by soldering and/or adhering a connector attached to a wire to a region of the surface of the glazing which has been printed using an electrically conductive ink. An adhesive may also be used in conjunction with the solder. Such electrical connections are well known, for example, as described in EP 1 256 261.

On an openable glazing, each connection must be securely adhered to the glazing, and the wiring directed through a waterproof housing into the vehicle for connection to the wiring harness. In the case of a glazing which is openable, such as the backlight on a hatchback car, at least one connection will be exposed to the elements each time the glazing or door containing the glazing is opened. In this situation it is also necessary to provide a cover over the connection to prevent damage from weathering, as well as to improve the overall appearance of the glazing.

There is therefore a need for an electrical connector device which can provide secure connection for wiring for at least one electrical function on an openable automotive glazing.

The present invention aims to address these problems by providing a connector, shaped to receive the edge region of an automotive glazing between opposing first and second connector arms, the automotive glazing having a first surface having an electrical function situated thereon, and a second surface, opposite the first, having a second electrical function situated thereon, wherein the first connector arm carries wiring for the first automotive glazing electrical function and the second connector arm carries wiring for the second electrical function.

By ensuring that the connector contacts the automotive glazing on opposing surfaces, it will be adhered securely to the edge region of the glazing without the need for adhesives, solder or screw fixings. By using at least one of the connector arms to carry wiring, such wiring can be directed to the appropriate surface of the glazing easily.

Preferably, the connector is slidable onto the edge of the automotive glazing.

Preferably, the connector arms form a friction fit with the edge region of the automotive glazing.

Preferably, the connector further comprises a cap which covers one connector arm and a connection between the wiring carried by that arm to the electrical function on the surface of the glazing.

Preferably the cap and the connector arm comprise complementary engagement means to enable the cap to form a mating fit with the connector arm. Preferably, the complementary engagement means comprise the cap having two protrusions and the connector arm having two cut outs, the cut outs and protrusions being sized to form a mating fit. More preferably, the complementary engagement means further comprises the cap having an inner wall, and the connector arm having a cut out portion to receive the inner wall.

Preferably, one of the first and second arms carries wiring for two or more electrical functions.

The invention also provides a vehicle glazing having such a connector mounted thereon.

The invention will now be described by way of example only, and with reference to the accompanying drawings in which.

In order to provide a secure electrical connection for an electrical function located on the surface of an openable automotive glazing, the present invention provides a connector which engages with an edge of the glazing and directs cables for the electrical function to the desired surface of the glazing.

Figure 1:
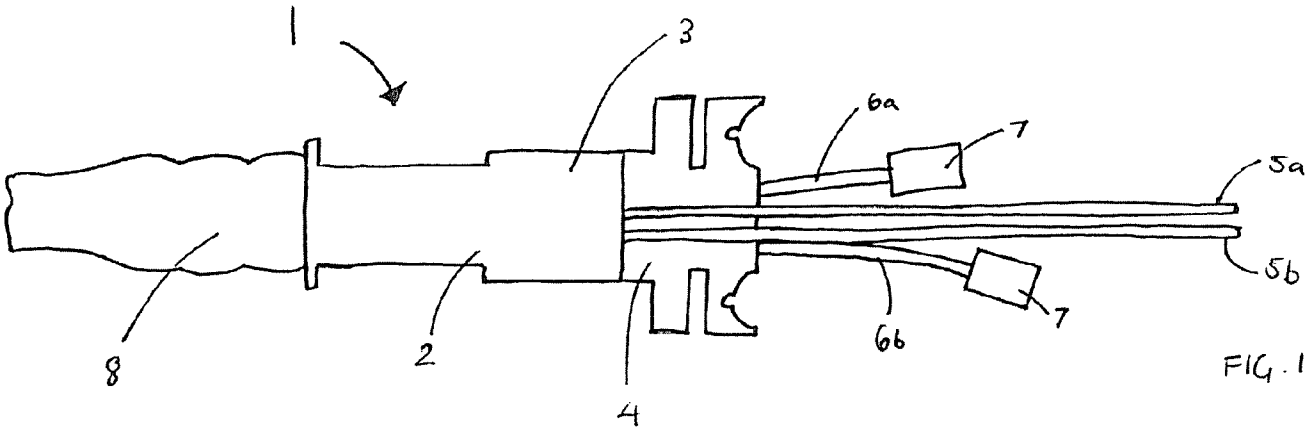
FIG. 1 is a schematic plan view of a connector in accordance with the present invention.

FIG. 1 is a schematic plan view of a connector 1 in accordance with the present invention. The connector is particularly used where two electrical functions, such as a heating circuit and a CHMSL (central high mount stop lamp) are located on opposite surfaces of an automotive glazing. The connector 1 comprises a main body 2 having first 3 and second 4 arms which contact opposite surfaces of a glazing to enable the connector to engage with an edge of the glazing. The first arm 3 carries wires 5*a* 5*b* that form the electrical connection between the wiring harness of the vehicle in which the glazing is fitted and a CHMSL on one surface of the glazing. The second arm 4 carries wires 6*a* 6*b*, each having a spade connector 7, for connecting the wiring harness of the vehicle to a heating circuit provided on a surface of the glazing. The wires 5*a*, 5*b*, 6*a*, 6*b* pass though the main body 2 of the connector 1, and though a neck portion 8.

A water-resistant corrugated tube (not shown) is placed over the neck portion 8, and the wires 5*a*, 5*b*, 6*a*, 6*ab* pass through the tube into the vehicle. The tube is visible when either the glazing or frame containing the glazing is in an open position, for example, when the backlight or boot of a car is opened. The end of the tube remote from the neck portion 8 is sealed onto the vehicle body, where the wires are connected into the wiring harness of the vehicle. The tube may be held onto the neck portion 8 by an adhesive, or by a series of ridges or helical screw thread formed in the neck portion 8, which form a friction fit with the inside of the tube.

Figure 2:
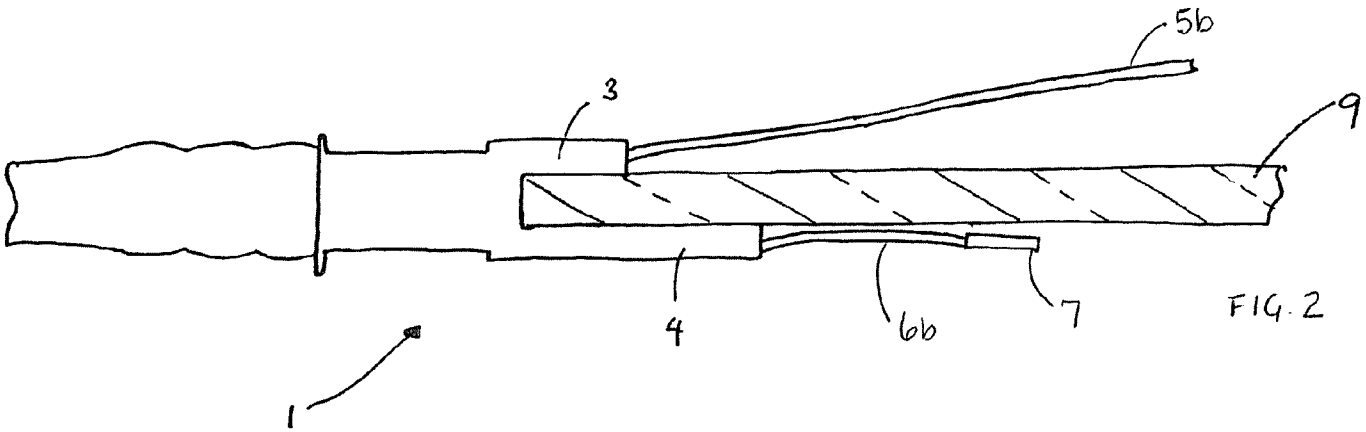
FIG. 2 is a schematic side view of a connector in accordance with the present invention.

FIG. 2 shows a schematic side view of the connector 1, illustrating more clearly the engagement of the connector 1 with the edge region of a glazing 9. The glazing 9 is shown in cross section for clarity. Although the glazing 9 is illustrated as being a single ply of glass, the glazing may alternatively be of a laminated construction. The first arm 3 contacts a first surface of the glazing 9, and the second arm 4 contacts the second, opposite surface of the glazing 9. The spacing between the arms is chosen to ensure a friction fit between the surfaces of the arms and the surfaces of the glazing 9.

When fitted onto the glazing 9, the antenna wires 5*a* 5*b* are covered with a foam protector strip, to prevent damage to the surface of the glazing 9 against which they lie. The antenna connection itself is made on an unexposed portion of the glazing. However, the connection for the heating circuit is made on a portion of the glazing that will be exposed to ambient weather conditions when the glazing is in an open position. In order to ensure that the connection is weatherproof, a cover is affixed to the glazing over the region where the spade connectors 7 are soldered to the glazing. This cover is discussed in detail in relation to FIG. 3 below.

Figure 3:
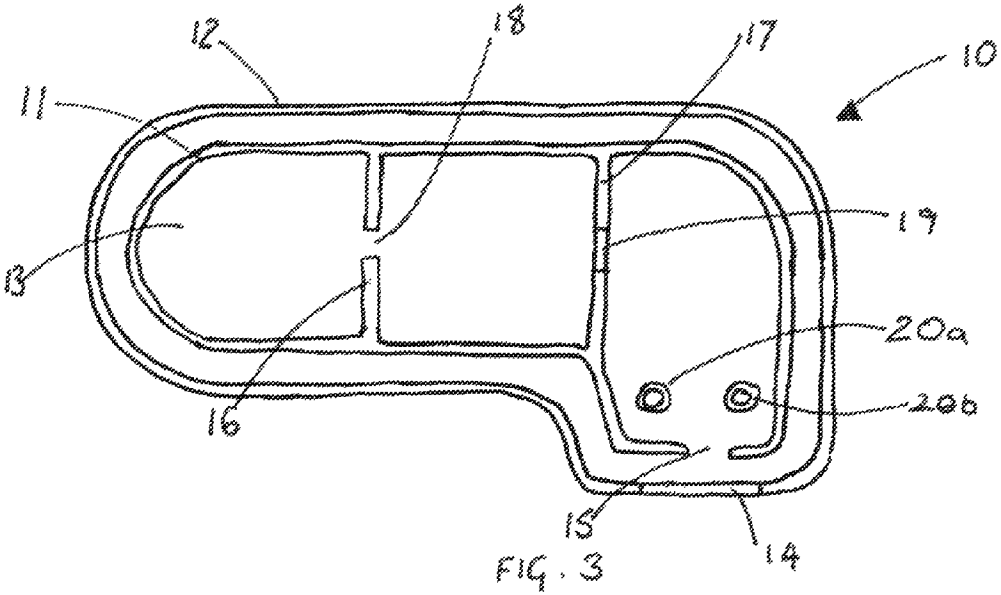
FIG. 3 is a schematic plan view of a connector cover for use with the present invention.

FIG. 3 shows a schematic plan view of a cover in the form of a cap 10, which covers the soldered electrical connections between the spade connectors 7 and the heating circuit on the glazing 9. The cap 10 is generally elongate in shape and comprises two walls, an inner wall 11 and an outer wall 12, joined to a roof portion 13. The outer wall 12 comprises a cut out portion 14 to receive the connector main body 2. The inner wall 11 comprises a break 15, and two internal walls 16 17. The first internal wall 16 has a break 18 for receiving an arm of one of the spade connectors 7. The second internal wall 17 comprises a cut out portion 19 to enable one of the cables 6*a* 6*b* to pass through. The inner wall 11 has a height h, which is less than the height H of the outer wall 12, and so does not contact the surface of the glazing. The heights $h_1$ and $h_2$ of the internal walls 16 17 are less than h, and may or may not be equal. The inner wall 11 and the roof portion 13 form a cavity in which the soldered connection and cables 6*a* 6*b* sit. The cap 10 also comprises two circular protrusions 20*a* 20*b*, which themselves may be in the form of a circular wall.

The method by which the connector and cap are fixed onto the glazing will now be described.

Initially, the connector 1 is pushed onto an edge region of a glazing 9, as the connector is shaped to receive the edge region of the glazing 9 between the opposing connector arms. The first 3 and second 4 arms contact opposite surfaces of the glazing 9, as shown in FIG. 2. As the spacing of the arms is designed to provide a friction fit with the glazing 9, no adhesive is needed. However, adhesive may be used if desired, in particular if the spacing of the arms does not provide a friction fit with the glazing 9 to ease the fitting of the connector 1 onto the glazing 7. Once the connector 1 is in position, the connector spades 7 on the heating circuit wires 6*a* 6*b* are soldered to connection points on the glazing. This arrangement is shown in more detail in FIG. 4.

Figure 4:
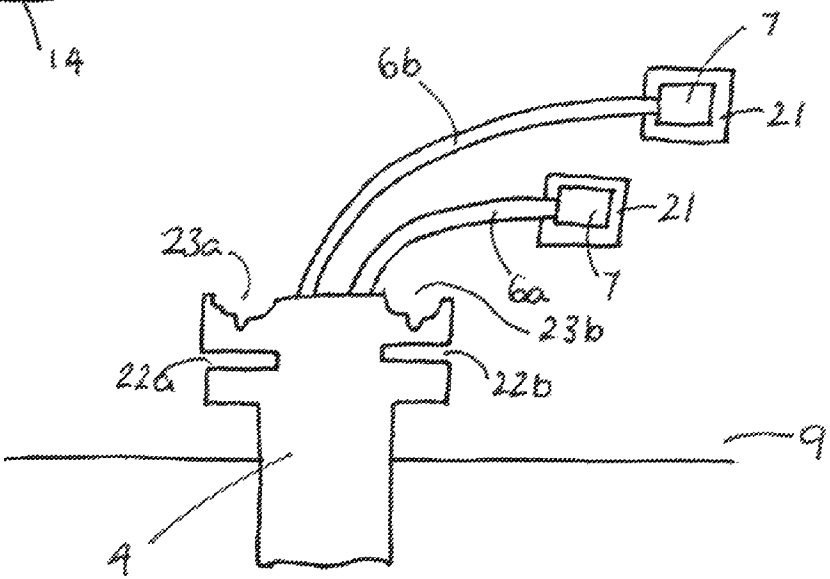
FIG. 4 is a schematic plan view showing the relationship between the connector cover, the connector and the electrical connections on the surface of a glazing.
Figure 5:
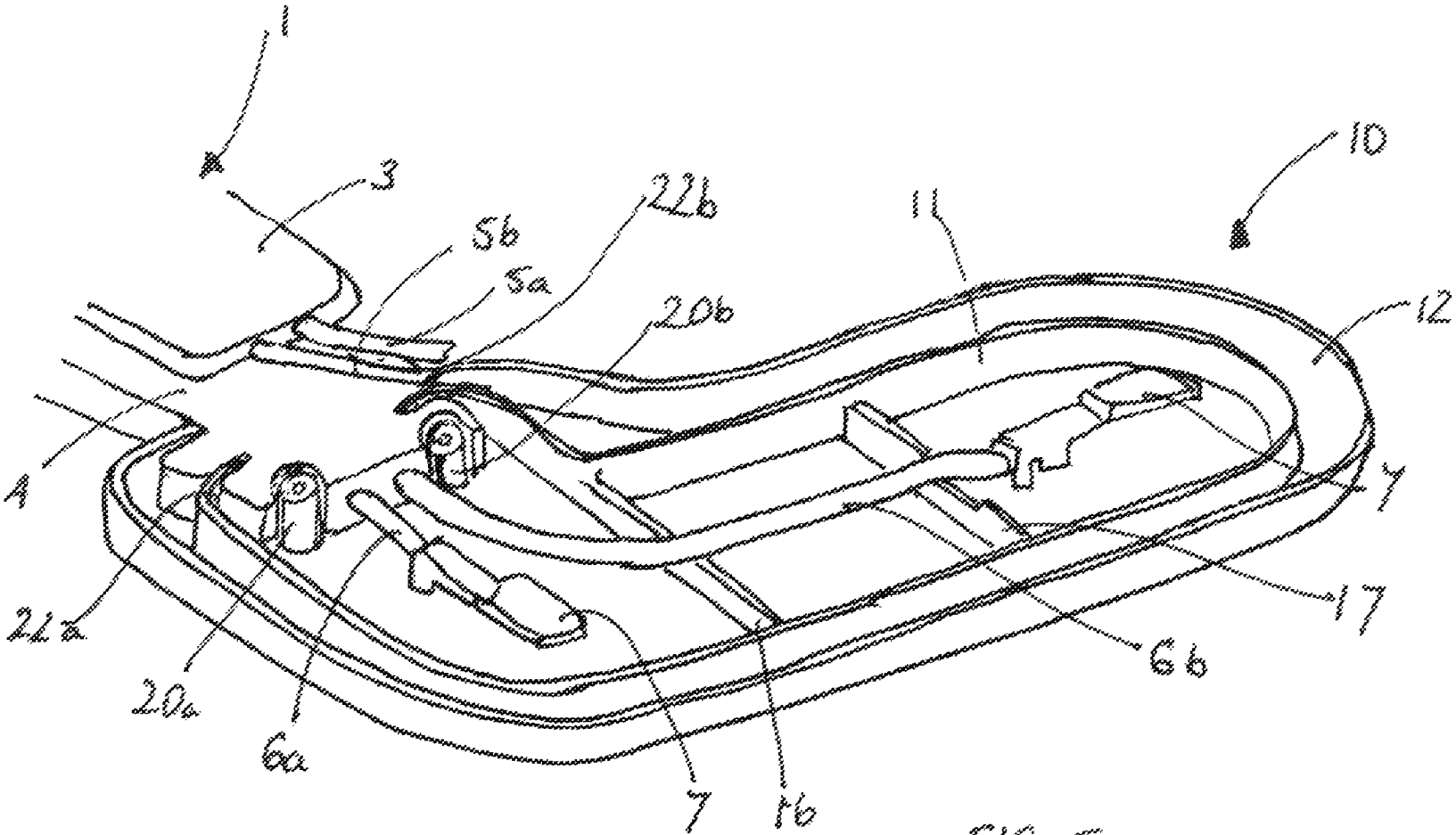
FIG. 5 is a schematic perspective view showing the relationship between the connector cover and the connector.

FIG. 4 is a schematic plan view of the connector 1 after it has been pushed onto the edge of the glazing 9. The connector spades 7 have been soldered to connection points 21, which are typically formed from a conductive silver ink printed onto a surface of the glazing 9. The connection points 21 may be provided directly onto the surface of the glass, or may be printed onto an opaque ceramic band, known as an obscuration band. FIG. 5 also shows the second arm 4 in more detail.

In order to provide a mating fit when the cap 10 is mounted on the second connector arm 4, complementary engagement means are provided. These complementary engagement means comprise protrusions 20*a* 20*b* and the inner wall 11 of the cap, and cut outs 22*a* 22*b* 23*a* 23*b* on the second connector arm 4, as described below.

The second arm 4 comprises two rectangular cut out portions 22*a* 22*b* and two substantially semi-circular cut out portions 23*a* 23*b*. When the cap 10 is placed over the connector 1, the rectangular cut out portions 22*a* 22*b* receive the inner wall 11, and the semi-circular cut out portions 23*a* 23*b* receive the protrusions 20*a* 20*b*, forming a mating fit. The cut out portions in the second arm 4 are sized and positioned such that when the cap 10 is clipped into place, the inner wall 11 and protrusions 20*a* 20*b* form a mating fit with the cut outs. One of the heating circuit wires 6*a* extends over the internal walls 16, 17, sitting in the break 18 and cut out portion 19.

Once the spade connectors 7 have been soldered into place, the cavity of the cap 10 formed by the inner wall 11 and the roof portion 13 is filled with a hot melt mixture, and the cap 10 clipped over the second arm 4. The hot melt material acts as both an adhesive and a sealant. When the cap 10 is pressed down onto the glazing, any excess hot melt moulding material is forced under the inner wall 12 into the gap between the inner wall 11 and outer wall 12. This ensures a waterproof covering whilst preventing any of the hot melt material from spilling out of the cap 10 and remaining visible on the surface of the glass once cured.

The hot melt moulding material may be one in which the polymerisation process is influenced by humidity. In this situation, the hot melt moulding material quickly hardens to a state which allows the glazing to be shipped before full curing has taken place. The remainder of the curing process occurs due to the humidity in the atmosphere during shipping and storage of the glazing. Preferably, the hot melt mould material used is a polyurethane material, which shows sufficient resistance to standard automotive industry salt spray tests.

As discussed above, the height h of the inner wall 11 is less than the height H of the outer wall 12. The height h of the inner wall 12 is determined by the viscosity and/or fluid behaviour of the adhesive/sealant used, and the height H of the outer wall 11 is determined by the size of the electrical connector, and space available within the vehicle in which the glazing is fitted. Preferably, the cap is made of a PBT (poly butylene terephthalate) glass fibre composite material, although other rigid, weather-resistant plastics materials are also suitable. The cap 10 may be of any desired colour, depending on what pigmentation is added to the plastics material during manufacture.

In the example described above, both the first and second arms of the connector carry electrical wiring. However, if only one surface of the glazing carries an electrical function, only the first arm needs to carry wiring, and the second arm may be used exclusively for securing the connector to the edge region of the glazing. Also, it may be desirable for one arm to carry wiring for two or more electrical functions.

The invention claimed is:

1. A connector, shaped to receive the edge region of an automotive glazing between opposing first and second connector arms, the automotive glazing including a first surface having a first electrical function situated thereon, and a second surface, opposite the first surface, having a second electrical function situated thereon, wherein the first connector arm carries wiring for the first automotive glazing electrical function and the second connector arm carries wiring for the second electrical function, the connector further comprising a cap which covers one connector arm and a connection between the wiring carried by the one connector arm to the electrical function on the surface of the glazing, the cap having a cavity for adhesive and sealant.

2. The connector of claim 1, wherein the connector is slideable onto the edge of the automotive glazing.

3. The connector of claim 1, wherein the connector arms form a friction fit with the edge region of the automotive glazing.

4. The connector of claim 1, wherein the cap and the one connector arm comprise complementary engagement means to enable the cap to form a mating fit with the one connector arm.

5. The connector of claim 4, wherein the complementary engagement means comprise the cap having two protrusions and the one connector arm having two cut outs, the cut outs and protrusions being sized to form a mating fit.

6. The connector of claim 4, wherein the complementary engagement means further comprises the cap having an inner wall, and the one connector arm having a cut out portion to receive the inner wall.

7. The connector of claim 1, wherein one of the first and second arms carries wiring for two or more electrical functions.

8. A vehicle glazing having the connector of claim 1 mounted thereon.

9. The connector of claim 2, wherein the connector arms form a friction fit with the edge region of the automotive glazing.

10. The connector of claim 5, wherein the complementary engagement means further comprises the cap having an inner wall, and the one connector arm having a cut out portion to receive the inner wall.

11. The connector of claim 1, wherein the cap covers a soldered electrical connection.

12. A connector, shaped to receive the edge region of an automotive glazing between opposing first and second connector arms, the automotive glazing including a first surface having a first electrical function situated thereon, and a second surface, opposite the first surface, having a second electrical function situated thereon, wherein the first connector arm carries wiring for the first automotive glazing electrical function and the second connector arm carries wiring for the second electrical function;

the connector further comprising a cap which covers one connector arm and a connection between the wiring carried by the one connector arm to the electrical function on the surface of the glazing, wherein the cap and the one connector arm comprise complementary engagement means to enable the cap to form a mating fit with the one connector arm.

13. The connector of claim 12, wherein the complementary engagement means comprise the cap having two protrusions and the one connector arm having two cut outs, the cut outs and protrusions being sized to form a mating fit.

14. The connector of claim 13, wherein the complementary engagement means further comprises the cap having an inner wall, and the one connector arm having a cut out portion to receive the inner wall.

15. The connector of claim 12, wherein the complementary engagement means further comprises the cap having an inner wall, and the one connector arm having a cut out portion to receive the inner wall.

16. An assembly comprising:

an automotive glazing including a first surface having a first electrical function situated thereon, and a second surface, opposite the first surface, having a second electrical function different from the first electrical function situated thereon, the two different electrical functions supplied by separate electrical connections; and a connector, shaped to receive an edge region of the automotive glazing between opposing first and second connector arms, wherein the first connector arm carries wiring for the first electrical function and the second connector arm carries wiring for the second electrical function.

17. The assembly of claim 16, wherein the connector is slideable onto the edge of the automotive glazing.

18. The assembly of claim 17, wherein the connector arms form a friction fit with the edge region of the automotive glazing.

19. The assembly of claim 16, wherein the connector arms form a friction fit with the edge region of the automotive glazing.

20. The assembly of claim 16, wherein the automotive glazing is transparent.

* * * * *